US006289527B1

(12) United States Patent
Truettner

(10) Patent No.: US 6,289,527 B1
(45) Date of Patent: Sep. 18, 2001

(54) TOILET SANITARY DEVICE

(76) Inventor: Kurt Truettner, 3440 Red Rock La., Flagstaff, AZ (US) 86001

( * ) Notice: Subject to any disclaimer, the term of this patent is extended or adjusted under 35 U.S.C. 154(b) by 0 days.

(21) Appl. No.: 09/502,388

(22) Filed: Feb. 11, 2000

(51) Int. Cl.[7] ..... E03D 9/00
(52) U.S. Cl. ..... 4/300.3; 4/DIG. 5
(58) Field of Search ..... 4/300.3, DIG. 5, 4/239, 237

(56) References Cited

U.S. PATENT DOCUMENTS

| | | | | |
|---|---|---|---|---|
| 23,561 | * | 4/1859 | Peabody | 4/DIG. 5 |
| 1,015,512 | * | 1/1912 | Ross et al. | 4/DIG. 5 |
| 1,109,904 | * | 9/1914 | Dahlgren | 4/DIG. 5 |
| 1,951,621 | * | 3/1934 | Mayette | 4/DIG. 5 |
| 2,407,005 | * | 9/1946 | Haley | 4/DIG. 5 |
| 2,839,764 | * | 6/1958 | Gardner | 4/DIG. 5 |
| 4,716,602 | * | 1/1988 | Brickhouse | 4/DIG. 5 |
| 5,222,809 | * | 6/1993 | Ehrenkranz | 374/141 |

FOREIGN PATENT DOCUMENTS

| | | | | |
|---|---|---|---|---|
| 2196031 | * | 4/1988 | (GB) | 4/237 |

* cited by examiner

*Primary Examiner*—Gregory L. Huson
*Assistant Examiner*—Khoa D. Huynh
(74) *Attorney, Agent, or Firm*—Donald J. Lenkszus

(57) ABSTRACT

A sanitary device for use with toilet seats is used to prevent urine from squirting out from the gap between a toilet seat and the toilet bowl. The sanitary device includes an arcuate portion extending downward from the toilet seat to bridge the gap between the under surface of the toilet seat and the rim of the toilet

7 Claims, 3 Drawing Sheets

TOILET SANITARY DEVICE

FIELD OF THE INVENTION

This invention pertains to sanitary devices, in general, and to a sanitary device for use with toilet seats, in particular.

BACKGROUND OF THE INVENTION

As most parents of little boys soon realize, one problem of universal concern is that toilet seats are not designed for sanitary use by small boys. The anatomy of small boys is such that when a small boy is sits on a toilet seat to urinate, more often than not the urine squirts out in the gap that is always present between the top of the toilet bowl and the lower surface of the toilet seat. Until such time as the child learns to direct the flow of urine into the toilet bowl, he inadvertently causes an unsanitary condition outside the toilet and sometimes on his own clothing.

In the past, various toilet training seats have been commercially available that include a cup like splash guard that typically extends above and/or below a training seat. The entire training seat is placed on top of an existing toilet seat. The disadvantages of toilet training seats are numerous. One particular disadvantage is that the boy has to be assisted onto the toilet seat because of the cup like splash guard that extends above the seat.

It would be highly desirable to provide a sanitary device that can be used with conventional toilet seats that does not materially alter the toilet seat, yet will permit the toilet to be used by small boys without concern that their inattentiveness or inability or lack of understanding results in urine spraying outside the toilet.

SUMMARY OF THE INVENTION

In accordance with the principles of the invention, a urine shield is provided that advantageously prevents the squirting of urine in the gap between the top or a toilet bowl and a toilet seat. Further in accordance with the invention, the urine shield is easily installed on any toilet.

In accordance with the principles of the invention, a urine shield includes an arcuate plastic portion extending downward from one or more flange portions. The one or more flange portions include adhesive fasteners such that the flange portion when pressed against the underside of the toilet seat attaches thereto.

In an illustrative embodiment of the invention, at last the arcuate plastic portion is formed from a medical grade plastic.

One embodiment of the invention is designed to be installed when the toilet seat is down to thereby ensure that the shield will clear the rim of the toilet when the toilet seat is raised.

In one embodiment of the invention, the flange portion and the arcuate portion are integrally formed as a one-piece unit.

Still further in accordance with the principles of the invention, an improved toilet seat includes an arcuate urine shield extending downward from the bottom of toilet seat. The shield is positioned at the front portion of the toilet seat proximate the hole in the seat. The shield extends a distance greater than the gap that exists between the bottom of the seat and the top of the toilet bowl when the toilet seat is installed on a bowl. In accordance with one aspect of the invention, the toilet seat carries feet on its bottom surface and the shield extends a distance below the bottom surface of the toilet seat that is greater than the height of the toilet seat feet.

BRIEF DESCRIPTION OF THE DRAWING

The invention will be better understood from a reading of the following detailed description taken in conjunction with the drawing in which like reference designators are used to identify like elements in the different drawing figures, and further in which.

DETAILED DESCRIPTION

Figure 1:
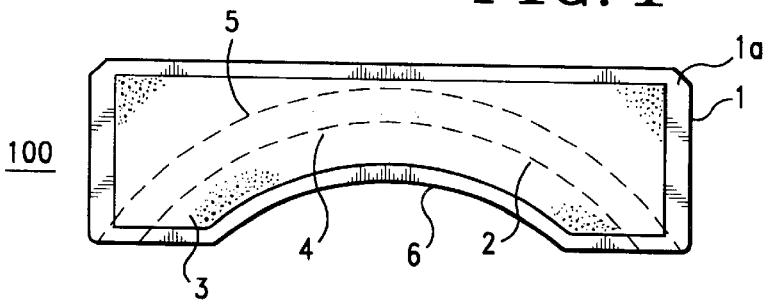
FIG. 1 is a top view of a first embodiment of the invention.
Figure 2:
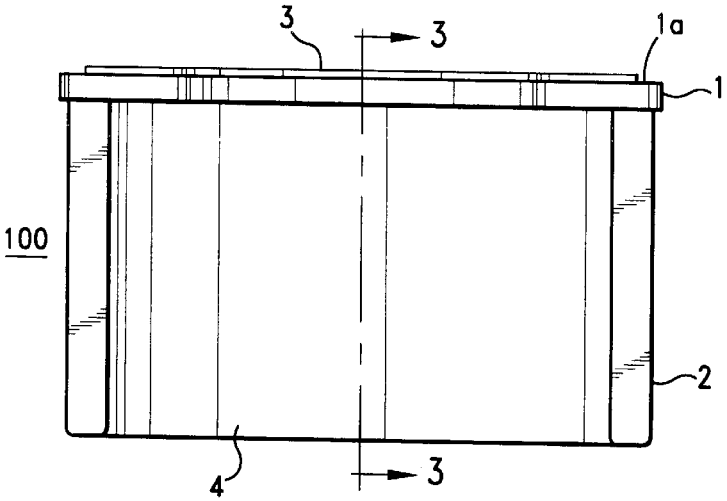
FIG. 2 is a front view of the shield of FIG. 1.
Figure 3:
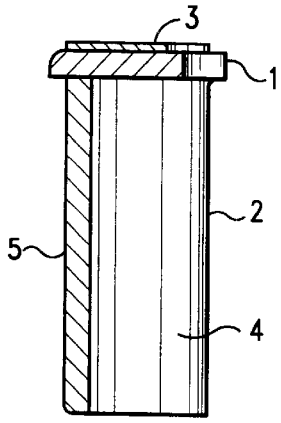
FIG. 3 is a cross sectional view of the device of FIGS. 1 and 2 taken along lines 3—3 of FIG.2.
Figure 4:
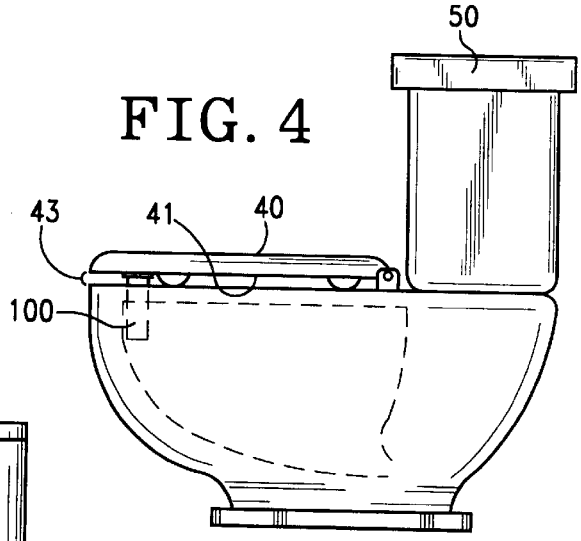
FIG. 4 illustrates the invention of FIGS. 1–3 installed on a toilet seat.
Figure 5:
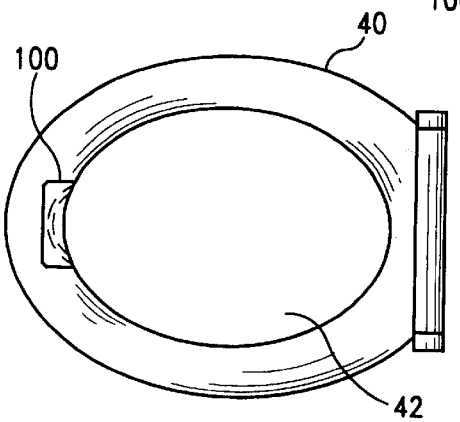
FIG. 5 is a top view of the toilet seat of FIG. 4.
Figure 6:
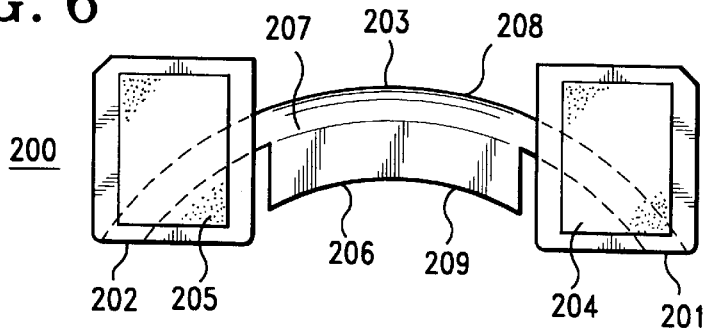
FIG. 6 is a top view of a second embodiment of the invention.
Figure 7:
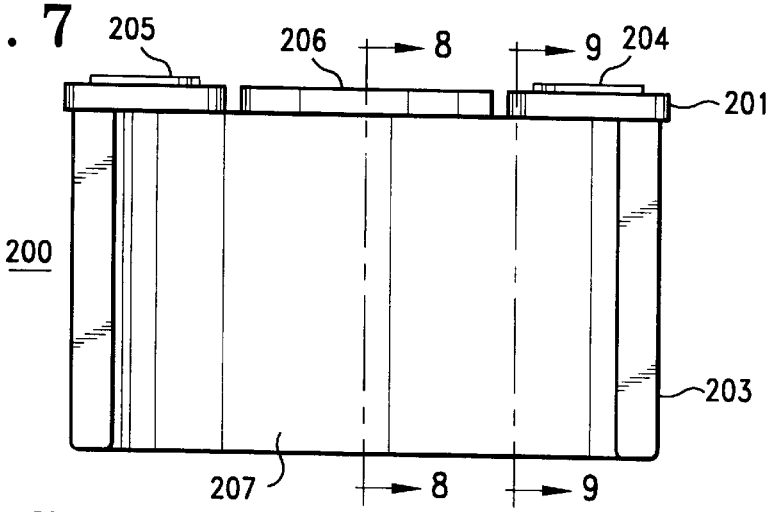
FIG. 7 is a front view of the shield of FIG. 6.
Figure 8:
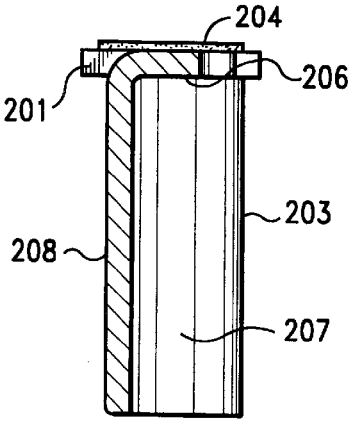
FIG. 8 is a cross sectional view of the shield of FIG. 7 taken along lines 8—8.
Figure 9:
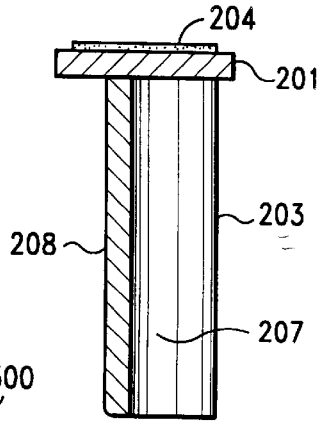
FIG. 9 is a cross sectional view of the shield of FIG. 7 taken along the lines 9—9.
Figure 10:
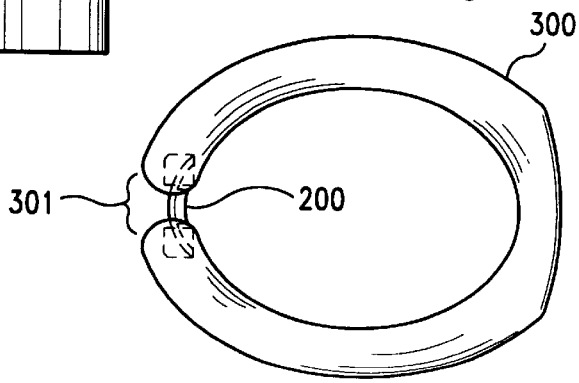
FIG. 10 illustrates the invention of FIGS. 6–9 installed on a toilet.

In the description that follows, reference may be made to different directions such as up, down, right and left. The directions are with reference to the embodiments of the invention as positionally shown in the drawing FIGS.

Various embodiments of the invention are described. FIGS. 1 through 5 depict a first embodiment of the invention that is particularly well adapted to home toilet seats and many commercial toilet seats. The second embodiment depicted in FIGS. 6 through 10 is particularly well adapted for commercial type toilet seats of the type in which there is a gap at the front of the toilet seat.

Turning now to the drawing FIGS. depicting the first embodiment of the invention, the sanitary device 100 includes an upper flange portion 1 and an arcuate portion 2 extending downward therefrom. Upper flange portion 1 has an upper surface 1*a*. An adhesive layer 3 is disposed on upper surface 1*a*. Adhesive layer 1*a*, in the illustrative embodiment of the invention is commercially available double sided adhesive tape. Arcuate portion 2 extends down from lower surface 1*b* of upper flange portion 1. Arcuate portion 2 is curved with concave surface 4 and convex surface 5. The curvature of arcuate portion 2 is selected so that when sanitary device 100 is installed on a toilet seat, convex surface 5 clears an inner curved surface of the toilet bowl of the toilet upon which the device is mounted. Upper flange portion 1 has a concave inner edge portion 6. The curvature of inner edge portion 6 is selected so that when sanitary device 100 is installed on a toilet seat, the upper flange portion does not extend beyond the toilet seat inner edge. Upper flange portion 1 and lower arcuate portion 2 are both formed of a medical grade plastic. In the illustrative embodiments shown herein, the sanitary devices are fabricated of Lexan™.

The upper surface of adhesive layer 3, prior to installation, is covered with a removable protective tape which is not shown. A kit including the sanitary device of the invention includes a prepackaged alcohol wipe and sanitary device. To install the sanitary device on a toilet seat such as the toilet seat 40 on toilet 50 shown in FIGS. 4 and 5, the toilet seat 40 is lifted. With toilet seat 40 raised, the prepackaged alcohol wipe is opened and used to clean the lower surface 41 in the vicinity of where sanitary device 100 is to be mounted. Toilet seat 40 is lowered. The removable protective tape is pulled off of adhesive layer 3 to expose it. The sanitary device 100 is then positioned on the lower surface 41 of toilet seat 40 with the toilet seat down through the toilet seat opening 42. By positioning sanitary device 100 in such a manner, when toilet seat 40 is raised or lowered, device 100 will clear the top of the toilet bowl.

With device 100 installed on a toilet seat, the spraying of urine through the gap 43 between the lower surface 41 of toilet seat 40 and the top of toilet 50 is blocked. Because device 100 is of medical grade plastic material, it is easy to maintain it in a sanitary condition. Arcuate portion 203 includes concave surface 207 and convex surface 208.

Sanitary device 200 is shown in FIGS. 6 through 10. Upper flange portions 201, 202 each carry adhesive portions 204, 205 respectively. Adhesive portions 204, 205 are each double sided adhesive tape of a commercially available type. Extending downward from the bottom surface of each of portions 201, 202 is arcuate portion 203. The curvature of arcuate portion 203 is selected so that when sanitary device 200 is installed on a toilet seat, convex surface 5 clears an inner curved surface of the toilet bowl of the toilet upon which the toilet seat to which the device is mounted. Sanitary device 200 is particularly well adapted to be mounted on a toilet seat such as toilet seat 300 shown in FIG. 10. Toilet seat 300 includes a gap 301 positioned at the front of the seat 300. Flange portions 201 and 202 are spaced apart such that each flange portion will engage the under surface of toilet seat 300 on either side of gap 301. Arcuate portion 203 includes a curved upper portion 206 that is shaped so that urine will not spray over the arcuate portion 203. Rather portion 206 will act to deflect urine impinging upon arcuate portion 203 back into the toilet.

Figure 11:
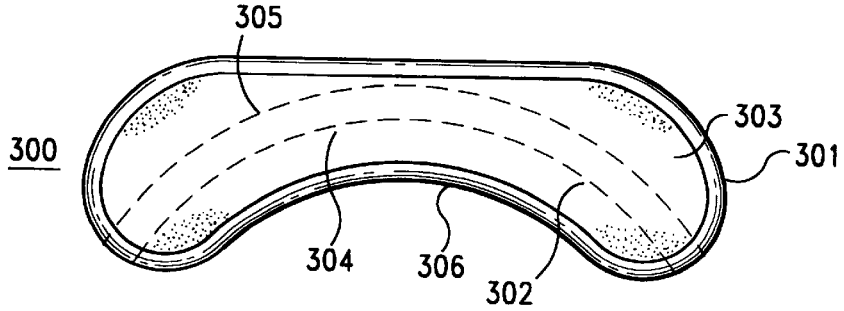
FIG. 11 is a top view of a third embodiment of the invention.
Figure 12:
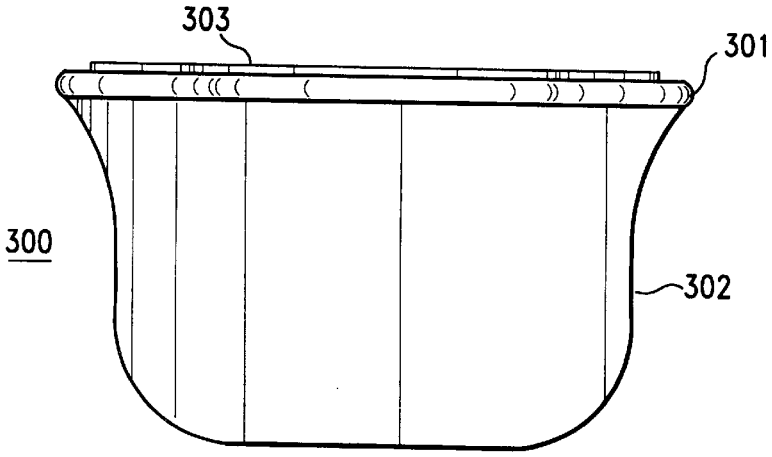
FIG. 12 is a front view of the shield of FIG. 11.
Figure 13:
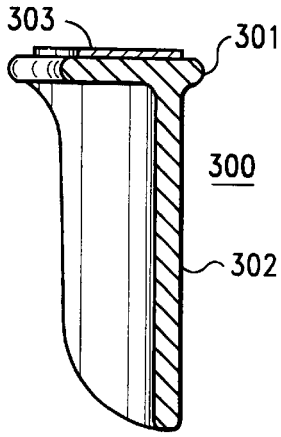
FIG. 13 is a side cross-sectional view of the shield of FIG. 12 taken along lines 13—13.

Sanitary device 300 is shown in FIGS. 11 through 13. Upper flange portion 301 carries adhesive portion 303. Adhesive portions 303 is double sided adhesive tape of a commercially available type. Extending downward from the bottom surface of each of flange portion 301 is arcuate portion 302. The curvature of arcuate portion 302 is selected so that when sanitary device 300 is installed on a toilet seat, convex surface 305 clears an inner curved surface of the toilet bowl of the toilet upon which the toilet seat to which the device is mounted. Sanitary device 300 has flange portion 301 integrally formed with arcuate portion 302. In other respects, sanitary device 300 is similar to sanitary device 100. Similarly, sanitary device 200 may have flange portions 201 and 202 integrally formed with arcuate portion 203.

Figure 14:
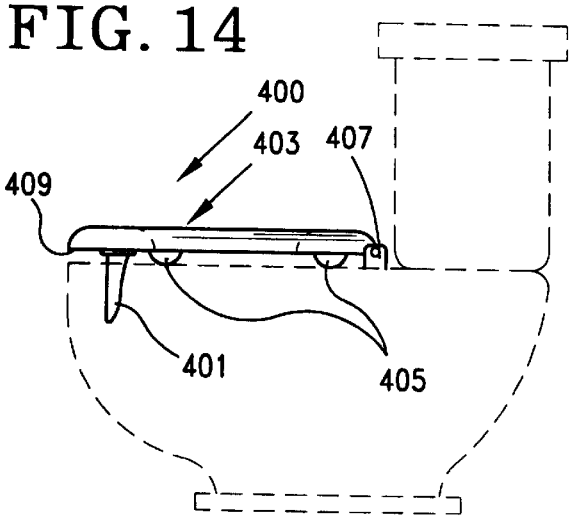
FIG. 14 illustrates in cross-sectional view a toilet seat in accordance with the invention.

FIG. 14 depicts a toilet seat 400 having an integrally formed urine shield 401. Toilet seat 400 has an aperture 403 through which individuals relieve themselves. Toilet seat 400 further includes feet 405 and a hinge apparatus 407 that serve to space the bottom surface 409 of the toilet seat from the top of the rim of the toilet bowl to which seat 400 may be mounted. The distance spacing between bottom surface 409 and the top of the rim is a predetermined distance, determined by the height of feet 405 and/or the hinge apparatus 407. Urine shield 401 extends a distance greater than the predetermined distance to bridge the gap between the toilet seat and the bowl to which it is mounted.

The invention has been described in terms of two illustrative embodiments. It will be understood by those skilled in the art that various modifications and changes may be made to the embodiments without departing from the spirit or scope of the invention. It is intended that the invention not be limited in any manner by the embodiments shown and described. It is intended that the invention be limited only by the claims appended hereto.

What is claimed is:

1. A sanitary device for use on an adult sized toilet seat comprising:

at least one flange portion, said flange portion having an upper surface:

adhesive carried on said upper surface for adhering said upper surface directly to a lower surface of a front portion of said adult sized toilet seat such that the entirety of said device is disposed below said toilet seat, said toilet seat being of a type wherein a rear portion of said adult sized toilet seat is coupled to a toilet bowl via a hinge such that said toilet seat is movable between a down position and an up position, when said toilet seat is in said down position said flange portion is extended in the direction of said hinge, and when said toilet seat is in said down position said lower surface is spaced apart by a gap from a top surface of said toilet bowl upon which said toilet seat is fastened;

an arcuate portion extending downward from said flange portion, said arcuate portion of a length selected to be longer than said gap such that said arcuate portion extends from said toilet seat lower surface beyond said toilet bowl upper surface when said toilet seat is in said down position to prevent passage of urine through said gap, said arcuate portion having a curvature and a width, said curvature and said width both selected so as to not contact said toilet bowl.

2. A Sanitary devise in accordance with claim 1, wherein:

said flange portion has an inner portion, said inner portion being proximate the bole in said toilet seat when said device is installed on said toilet seat, said inner flange portion having a second curvature such that said one flange portion is not visible when said toilet seat is in a down position.

3. A sanitary device in accordance with claim 1, comprising:

double sided adhesive tape having one side affixed to said upper surface.

4. A sanitary device in accordance with claim 3, wherein:

said arcuate portion comprises a medical grade plastic.

5. A sanitary device in accordance with claim 4, wherein:

said flange portion comprises a medical grade plastic.

6. A sanitary device in accordance with claim 1, comprising:

a removable protective coating on said adhesive on said at least one flange portion.

7. A sanitary device in accordance with claim 1, wherein:

said at least one flange portion and said arcuate portion are integrally formed as one piece.

* * * * *